US008302594B2

(12) United States Patent
Kendall

(10) Patent No.: US 8,302,594 B2
(45) Date of Patent: Nov. 6, 2012

(54) AIR CONTROL REGULATOR FOR COMBUSTION CHAMBER

(75) Inventor: Mark Wiliam Kendall, Auckland (NZ)

(73) Assignee: Flamekeeper, LLC, Deerfield Beach, FL (US)

( * ) Notice: Subject to any disclaimer, the term of this patent is extended or adjusted under 35 U.S.C. 154(b) by 0 days.

(21) Appl. No.: 13/328,045

(22) Filed: Dec. 16, 2011

(65) Prior Publication Data

US 2012/0085338 A1 Apr. 12, 2012

Related U.S. Application Data

(63) Continuation of application No. 12/101,658, filed on Apr. 11, 2008, now Pat. No. 8,079,358.

(30) Foreign Application Priority Data

Apr. 11, 2007 (NZ) ..... 554452

(51) Int. Cl.

| | |
|---|---|
| ***F23L 3/00*** | (2006.01) |
| ***F16K 17/34*** | (2006.01) |
| ***F16K 31/36*** | (2006.01) |
| ***B65D 51/16*** | (2006.01) |
| ***F23N 3/00*** | (2006.01) |
| ***G05D 7/01*** | (2006.01) |

(52) U.S. Cl. ..... 126/285 R; 126/285 A; 126/530; 137/484.2; 137/504; 137/517; 251/12; 251/124; 220/203.2; 236/45; 138/46

(58) Field of Classification Search ..... 126/285, 126/285 A, 285 R, 530; 137/484.2, 504, 137/517; 251/12, 124; 220/203.2; 236/45; 138/46

See application file for complete search history.

(56) References Cited

U.S. PATENT DOCUMENTS

| | | | | | |
|---|---|---|---|---|---|
| 172,774 | A | * | 1/1876 | Ford et al. | 138/46 |
| 835,221 | A | * | 11/1906 | Hyatt | 138/46 |
| 1,063,933 | A | * | 6/1913 | Keller | 138/46 |
| 1,134,159 | A | * | 4/1915 | Ridderstedt | 236/25 R |
| 1,974,567 | A | * | 9/1934 | Gerlach | 236/45 |
| 2,022,143 | A | * | 11/1935 | Mottershall | 454/360 |
| 3,319,669 | A | * | 5/1967 | Abplanalp | 141/20 |
| 3,763,884 | A | * | 10/1973 | Grassi et al. | 137/504 |

* cited by examiner

*Primary Examiner* — Kenneth Rinehart
*Assistant Examiner* — William Corboy
(74) *Attorney, Agent, or Firm* — Feldman Gale, P.A.; Michael C. Cesarano

(57) ABSTRACT

An air control regulator regulates the amount of air flowing into the inlet of a combustion chamber by causing flowing air to support a disc located in the air passage against the force of gravity. Air passes around the edges of the disc and is channeled into a plurality of airflows by ovoid depressions in the inner surfaces of the regulator forming a venturi chamber. By regulating the airflow into the combustion chamber, combustion efficiency is improved.

8 Claims, 5 Drawing Sheets

AIR CONTROL REGULATOR FOR COMBUSTION CHAMBER

CROSS-REFERENCE TO RELATED APPLICATIONS

This application is a continuation of U.S. application Ser. No. 12/101,658, filed on Apr. 11, 2008, now allowed, which claims priority under 119(a-e) to New Zealand Provisional Application No. 554452, filed on Apr. 11, 2007. The disclosures of each of the above-identified applications are hereby incorporated herein by reference in their entireties.

FIELD OF THE INVENTION

The invention relates to an air control regulator for a fireplace, furnace, boiler, or equivalent thereof.

BACKGROUND OF THE INVENTION

Operation of fireplaces generally requires, air inflow leading to a firebox. Examples of fireboxes include, but are not limited to furnaces, boilers, or an equivalent thereof. Fireboxes and can be incorporated into a manifold system comprising a network of pipes having an air inlet pipe able to "suck in" or draw in air as needed by the combustion process during operation. Air is critical in combustion and effects the combustion rate and heat output.

Existing means to control air include manifolds or pipe systems with several holes or vents. Some manifolds can have capped ends with movable vent covers. These types of systems are normally manually operated and adjusted according to changing conditions associated with any environmental fluctuations such as, for example, changes in temperature and wind. Problems with often arise with these systems when a fire is starved of air, or, conversely, when there is too much air which can cause the fire to burn too quickly and consume more fuel than is necessary.

OBJECTS OF THE INVENTION

It is an object of the invention to provide an air control regulator having a modest manufacturing cost, automatic or self regulating operation, simple installation, few moving parts. It is a further object of the invention to provide an air control regulator capable of being retrofitted to existing fireboxes, and capable of being combined with new fireboxes. It is a further object of the invention to provide an air control regulator having a compact design that enables fitting in most situations, and that is capable of accommodating variables in firebox size, chimney length, fuel size, stoking procedures, fuel-rich start and stoking. It is a further object of the invention to provide an air control regulator having a lean fuel burn. It is a further object of the invention to provide an air control regulator that is manually adjustable and discreet in operation. It is a further object of the invention to provide an air control regulator capable of coping with high and low winds and wind surges. It is a further object of the invention to provide an air control regulator having a safe operation and increased fuel efficiency. It is a further object of the invention to provide an air control regulator having reduced peak temperatures and emissions. It is a further object of the invention to provide an air control regulator capable of being overridden. It is a further object of the invention to provide an air control regulator having less of a likelihood of sudden influxes of extreme heat. It is a further object of the invention to provide an air control regulator capable of limiting the extent of chimney fires by limiting air availability during combustion. It is a further object of the invention to provide an air control regulator capable of tolerating a cold start.

SUMMARY OF THE INVENTION

The present invention can be generally described as an air control regulator comprising a body, preferably cylindrical in outer configuration, being attachable to an air inlet of a firebox, furnace, boiler, or equivalent thereof. The body further comprises a movable disc which is constructed and adapted to slide along a first support rod in one direction in response to incoming air and in the opposite direction in response to gravity, thereby regulating the size of an air passage for incoming air such that combustion efficiency of the firebox is improved.

Preferably, the first support rod is adjustably supported by a crossbar mounted diametrically on the body of the control regulator.

Preferably, a second support rod is adjustably supported by the bar wherein an upper disk stop member is mounted thereon. Preferably, the upper disk stop member has an aperture to allow the first support rod to slidably pass through and further prevent the disc from moving any further upwards when in use.

Preferably, the first support rod has a lower disc stop member to prevent the disc from moving any lower when in use.

In the preferred embodiment, the body has an interior ovaloid opening having a plurality of arc-shaped depressions and scalloped lips. The ovaloid opening leads into a venturi shaped chamber having tapered walls. Air flow entering the ovaloid opening forms into a plurality of air columns, as it contacts the plurality of arc-shaped depressions. The number of air columns is dependent upon the number of arc-shaped depressions.

In a preferred embodiment, the disc has a plurality of apertures to allow air to pass therethrough.

Preferably, the control regulator is connectable to a combustion chamber.

When a fire is drawing sufficient air, the airflow will lift the disc off the lower disc stop member and raise it into the venturi chamber. The upper disc stop member, which is vertically adjustable with the second support rod, limits the upward vertical movement of the disc. The plurality of air columns in the venturi chamber maintain the disc in a steady position. The weight of the disc, acting under the force of gravity, then causes the disc to move downward, pushing the flow of air against the tapered sides of the venturi chamber and narrowing the air flow passage. This movement slowly dampens the volume of the air drawn air into the combustion chamber or the fireplace, and allows the disc member to continue to descend slowly towards the lower portion of the venturi chamber. Once the disc is in the lower portion of the venture chamber, air flows around the disc, through the openings between the ovaloid perimeter and the disc. At this stage, the disc is no longer supported by columns of air and descends to a resting position on the lower disc stop member. The result is a lean burning combustion that either extinguishes the fire or is capable of being repeated by re-stoking the foregoing cycle.

DETAILED DESCRIPTION

The following description will describe the invention in relation to preferred embodiments of the invention. The invention is in no way limited to these preferred embodiments. Possible variations and modifications would be readily apparent without departing from the scope of the invention.

Figure 1:
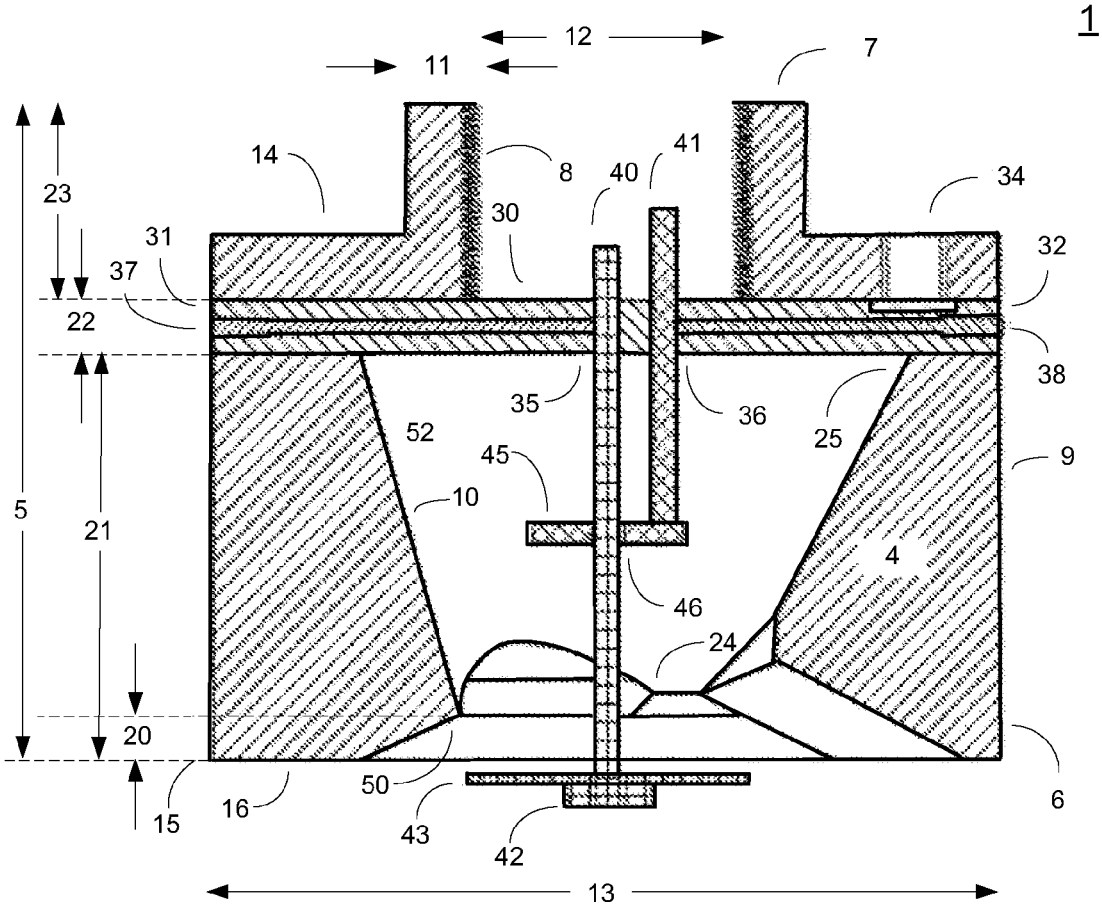
FIG. 1 is a cross sectional view of the control regulator.
Figure 3:
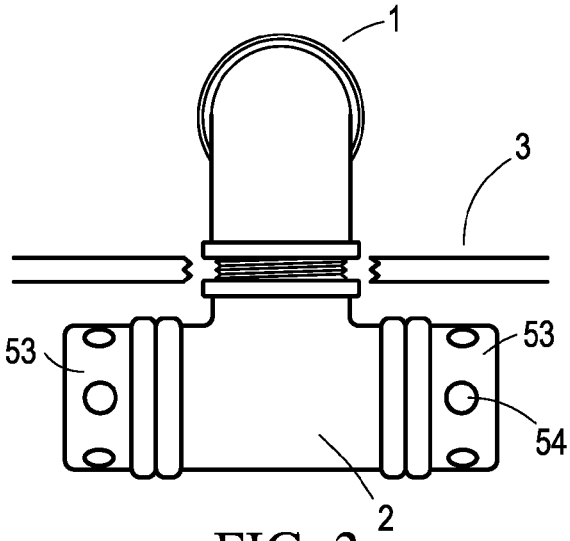
FIG. 3 is a top-plain view of a typical firebox manifold arrangement with the control regulator being fitted thereon.
Figure 4:
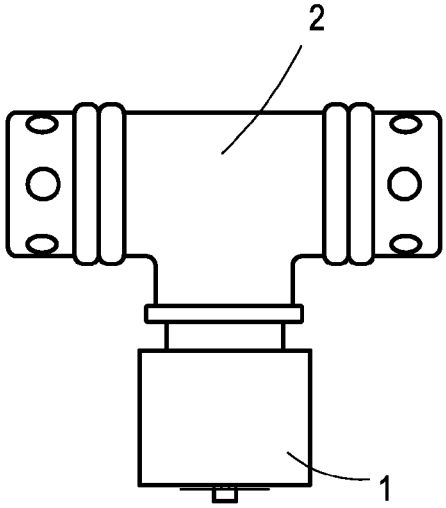
FIG. 4 is a side view of the same arrangement illustrated in FIG. 3.
Figure 5:
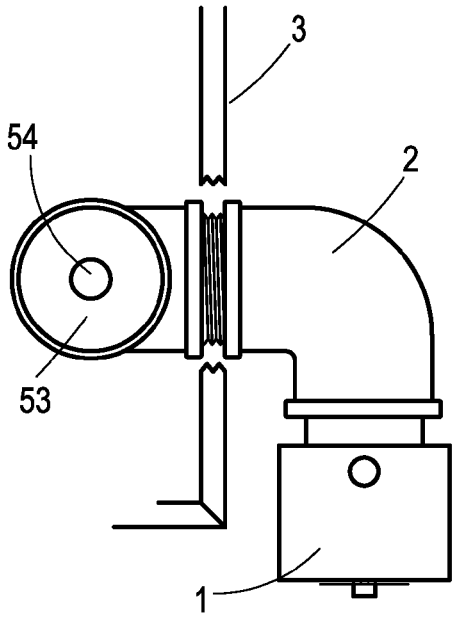
FIG. 5 is another side view of the arrangement illustrated in FIG. 3.
Figure 6:
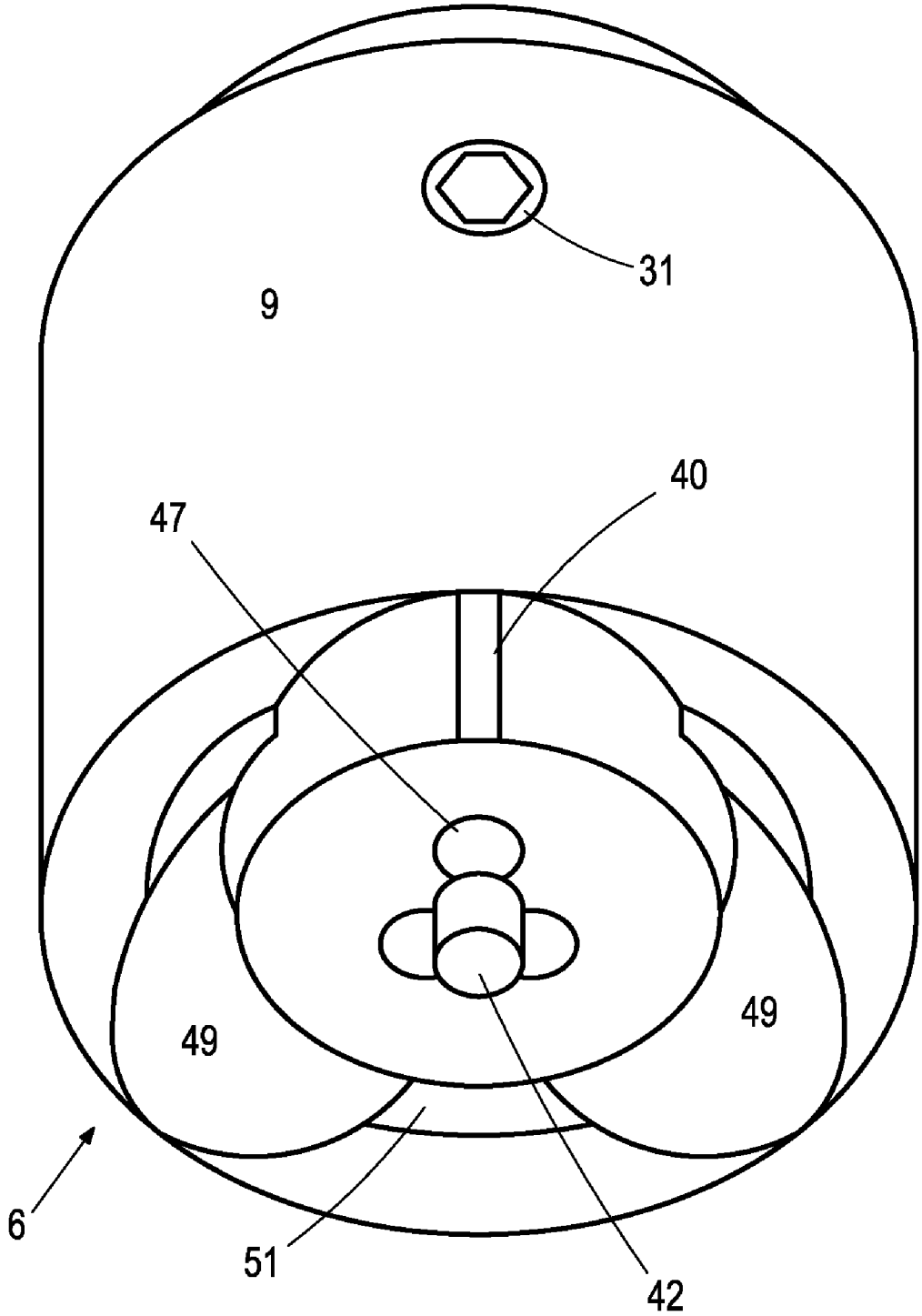
FIG. 6 is a perspective view of the inlet end of the control regulator.

As depicted in FIG. 1, control regulator 1 comprises a body 4, preferably having a substantially cylindrical outer shape, a length 5, variable inner and outer diameters 12 and 13, a non-attachable end 6, and an attachable end 7. The attachable end 7 has internal threads 8 for attaching the control regulator to a firebox manifold 2 or equivalent thereof, as shown in FIGS. 3-5. Other means of affixing the control regulator are equally possible, including but not limited to press fitting or external threading. Incoming air enters body 4 via non-attachable end 6, flows through the body, and exits from attachable end 7.

Body 4 has outer walls defining an outer wall surface 9 and inner walls defining an inner wall surface 10. Outer wall surface 9 and inner wall surface 10 further define a variable wall thickness having an inner diameter 12, and outer diameter 13 which vary along the length 5. In one embodiment, the shoulder 14 of the outer wall is shaped in a stepped manner to facilitate removable affixing of the control regulator to any external device such as a manifold 2. The outer walls can be shaped and dimensioned as desired. Non attachable end 6 has a leading outer corner edge 15 and inner corner edge 16.

Inner wall surface 10 may or may not be similar in shape to outer wall surface 9. As shown in FIG. 1, inner wall surface 10 defines an internal configuration comprising a lower first portion 20, leading upwardly to a second portion 21, a third portion 22 above the second portion, and uppermost, a fourth portion 23. In a preferred embodiment, the inner wall surface 10 is shaped in a stepped fashion comprising tapered and angled or curved portions forming a venturi chamber.

As shown in FIG. 1, fourth portion 23 has substantially parallel inner and outer walls, with internal threading 8, for engaging a pipe, manifold 2, or any equivalent air receiving means which can be connected to a firebox.

Figure 2:
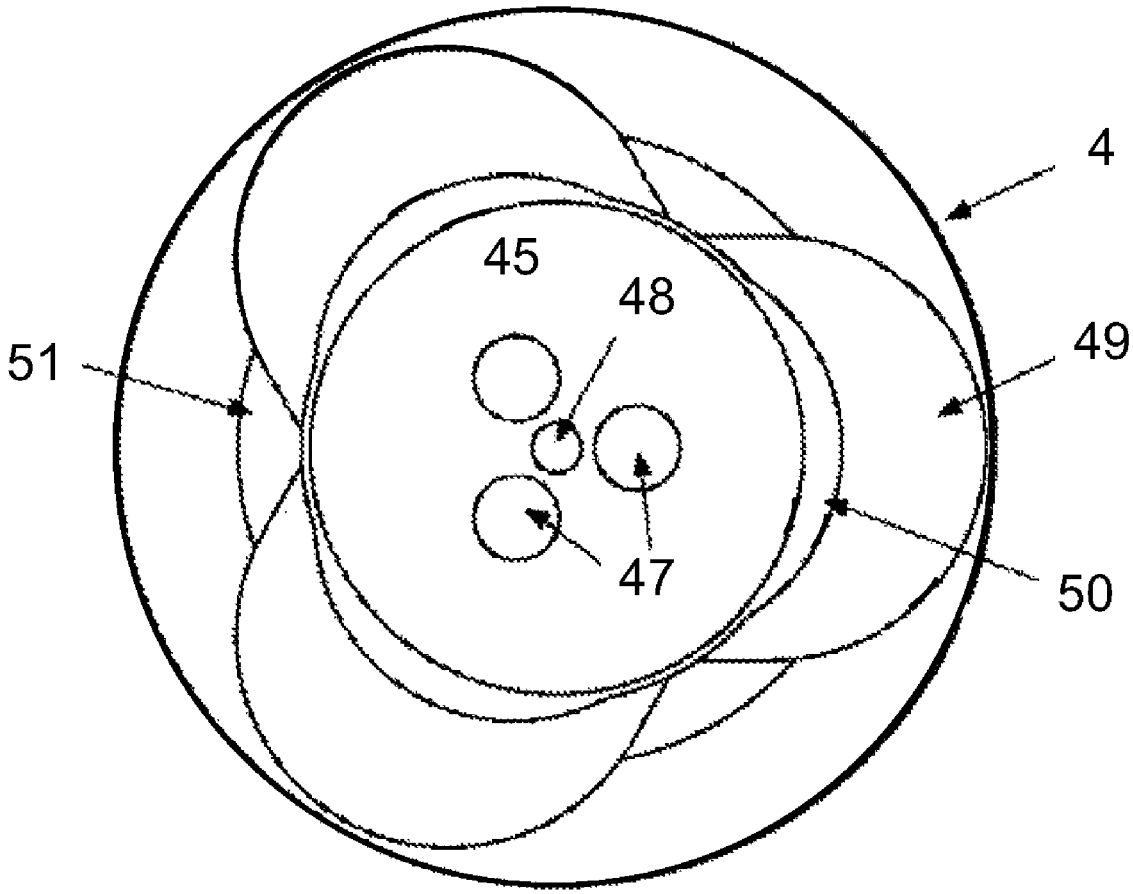
FIG. 2 is a forward view of the control regulator.

As further depicted in FIG. 1, first portion 20 tapers inwardly before leading into the venturi chamber formed by the upper portions of the body 4. The venturi chamber includes a choked section above circumferential line 25. Inner surface 24, located within second portion 21, does not form a general single curvature, but comprises a series on interconnected differing curves being made up of different diameters and ovaloids. First portion 20 which is located at the inlet or front face of regulator body 4 can be formed as planar slopes or, in the preferred embodiment shown in FIG. 2, may consist of several interconnected curvilinear slopes of different curve diameters which are three semi-diameters spaced equidistant around the inner edge of regulator body 4. The semi-diameters are angled in and towards the centre of the body. While three semi-circular diameters are shown in FIG. 2, the number of diameters may be greater or lesser than three.

Control regulator 1 has a support crossbar 30 extending across the diameter of regulator body 4, and is located near attachable end 7 of the body 4. Support bar 30 has ends 31 and 32 supported by the thickness of the body walls at ends 31 and 32. Support bar 30 can be removably fixed and adjustably attached by first fixing means 34 such as being threadingly, engaged and/or being keyed in place with screw fixing means or some other equivalent which can be accessed from the shoulder 14. As depicted in FIG. 1, support bar 30 is located in third portion 22. Support bar 30 can be adjusted rotationally in an arc and longitudinally. Support bar 30 is further comprised of a hollow or solid cross section having a determined thickness, diameter, and shape that can be circular or square. Support bar 30 is further comprised of two spaced apart apertures 35 and 36.

Apertures 35 and 36 are sized to allow passage of first and second support rods 40 and 41 therethrough so that support rods 40 and 41 are oriented substantially parallel with the body length 5 and with each other. First support rod 40, acts as a guide for movement of the disc 43, and is further comprised of lower disc stop member 42. Disc 43 has a central hole, and is disposed about first support rod 40, and is vertically movable along it. Lower disc stop member 42 is located near non-attachable end 6. First support rod 40 is adjustably and slidably supported near attachable end 7. Preferably, support bar 30 is further comprised of a second fixing member 37 for affixing first support rod 40. Second fixing member 37 is preferably comprised of a guide pin and locking screw extending within support bar 30 and abutting the side of first support rod 40. The guide pin and locking screw can be unscrewed or screwed to allow first support rod 40 to move up or down. As depicted in FIG. 1, first support rod 40 is centrally located in the body 4. First support rod 40 can be mounted and positioned such that first support rod 40 can be laterally and rotationally adjusted if desired.

Support bar 30 is further comprised of a third fixing member 38 for fixing second support rod 41. Third fixing member 38 preferably comprises a guide pin and locking screw located within the length of support bar 30. One end of third fixing member 38 abuts second support rod 41, and the other end of third fixing member 38 contacts and is coincident with the outer wall surface 9 to permit adjustment of third fixing member as desired. Second support rod 41 provides a fixed support for an upper disc stop member 45. Upper disc stop member 45 is preferably comprised of a first aperture 46 to allow first support rod 40 to slide therethrough. Second support rod 41 can be independently adjusted to position upper disc stop member 45 as desired. When first support rod 40 moves up, disc 43 eventually contacts upper disc stop member 45 and is restricted from any further upward movement.

As illustrated in FIG. 2, disc member 43 has at least one aperture 47 and a disc diameter that is smaller than the main internal diameter of body 4 so that disc 43 can slidably move up and or down first support rod 40 between upper and lower disc stop members 45 and 42, thus choking the air flow as desired. Preferably, upper disc stop member 45 covers any aperture(s) in disc 43. Preferably, disc 43 is further comprised of a centrally located, aperture 48. Aperture 48 allows disc 43 to slidably attach to first support rod 40. Disc 43 can be made of a specified gauge and material type according to the desired performance required.

As shown in FIG. 2, first portion 20 is comprised of a plurality of arc-shaped depressions 49, an ovaloid opening 50, and a plurality of scalloped edges 51. In a preferred embodiment, there are three arc-shaped depressions 49 and three scalloped edges 51, spaced equidistantly around the lip 16 of ovaloid opening 50. When air passes into ovaloid opening 50, three air columns are formed as the air flow contacts arc-shaped depressions 49. Different numbers of arc-shaped depressions and scalloped edges are possible. The number of air columns formed is dependent on the number of arc-shaped depressions.

Control regulator 1 can be incorporated into an existing firebox. As depicted in FIGS. 3-5, control regulator 1 can be retrofitted to an existing firebox by drilling or punching a hole into the rear of the firebox. Manifold 2 can be in the form of a "T" section with capped ends 53, metering vents 54, and an elbow-shaped section for attachment of the control regulator 1 which can be varied according to the size of the regulator and firebox. The metering vents 54 can also be sized in accordance with their compatibility with control regulator 1. Retrofitting control regulator 1 will not interfere with the operation of any controllable air vents on an existing firebox.

The control regulator 1 automatically controls and limits the amount of air flowing into an enclosed firebox, combustion chamber, furnace, or equivalent thereof, which, in turn, affects the heat output. The moving disc 43 regulates the airflow by slidably moving up and down first support rod 40 between the lower and upper disc stop members 42 and 45.

Control regulator 1 is in an open position when disc 43 rests on lower disc stop member 42. When disc 43 rests in the open position air is free to enter body 4. When a fire is ignited, drawn air flows past disc 43 through the first portion 20, and forms a plurality of air columns as a result of contacting the plurality of arc-shaped depressions and scalloped edges comprising first portion 20. When the fire is drawing sufficient air, disc 43 will be lifted past the ovaloid opening 50 into the venturi chamber—formed by second and third portions 21 and 23. Upper disc stop member 45, which is preferably adjustable vertically with second support rod 41, limits the maximum flow of the air. Disc 43 is steadily supported by the resulting plurality of air columns. Subsequently, the force of gravity causes the weight of disc 43 to direct the air flow on to the tapered sides of the venturi chamber, slowly damping the volume and speed of air drawn into the combustion chamber of the firebox. Disc 43 will then slowly descend toward ovaloid opening 50 at which point air begins passing disc 43 through a plurality of apertures between the ovaloid opening 50 and the disc 43. At this stage, the disc is no longer supported by columns of air and descends to a resting position. The result is a lean burning combustion that either extinguishes or is repeated by re-stoking the foregoing cycle.

Figure 7:
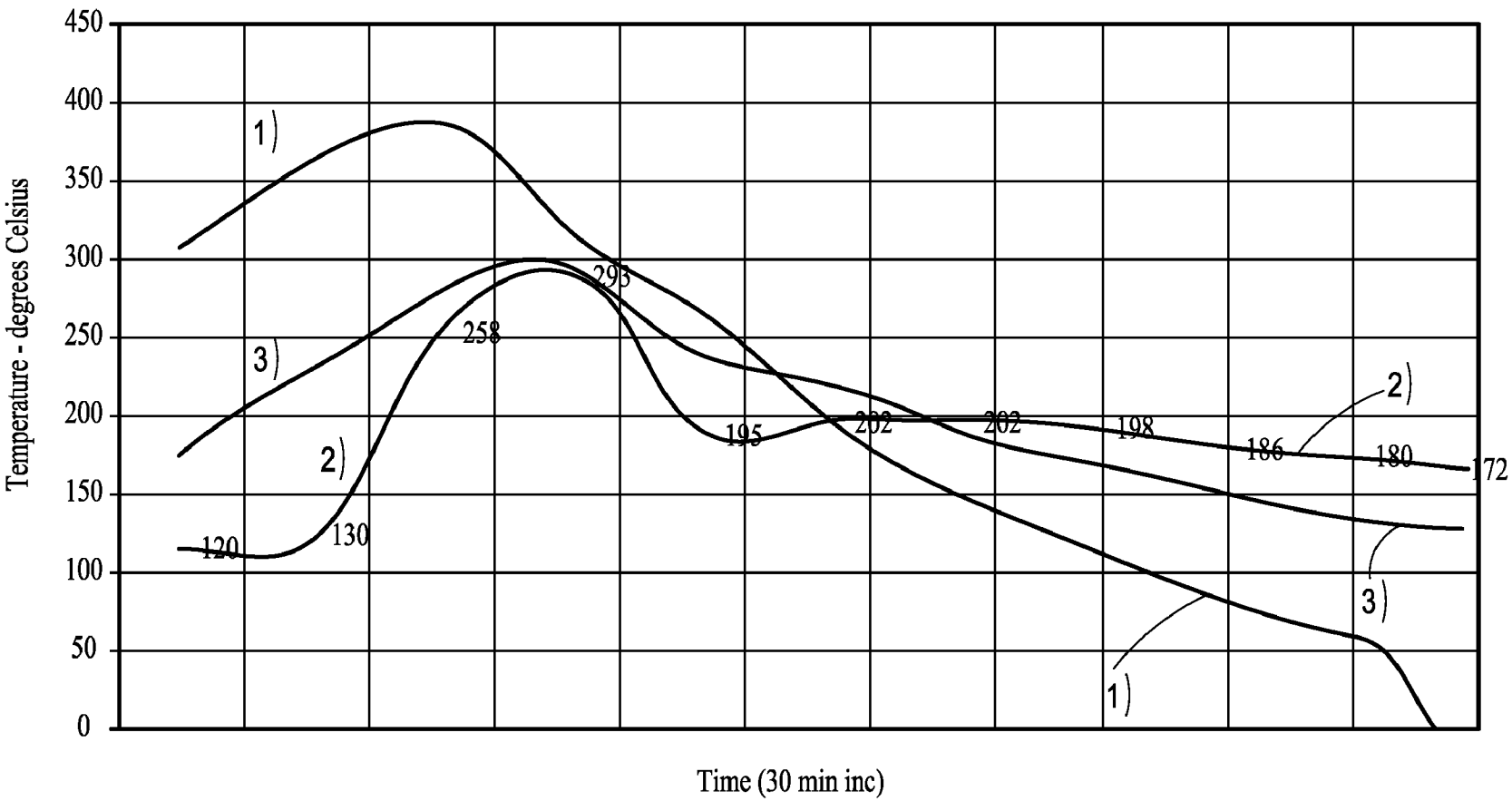
FIG. 7 is a graphical representation of the efficiency of the control regulator in a firebox in comparison with a firebox without the regulator.

FIG. 7, depicts a graphical comparison of temperature in degrees Celsius (Y axis) versus time (X axis) taken at the rear of a firebox at 30 minute intervals for (1) an unmodified firebox; (2) a closed firebox with the control regulator with air vents closed and air tube removed; and (3) a closed firebox with the control regulator air vents closed and air tube removed.

The difference in peak firebox temperatures between (1) and (2) is 100 degrees Celsius. After three hours the difference between (1) and (2) shows the control regulator having a marked advantage. At the five hour point, unmodified firebox (1) has extinguished while modified firebox (2) is still running at 150 degrees Celsius. At the five hour point (2) has maintained a higher level of effectiveness over (1) by approximately 50%. Therefore the control regulator has a marked effect on the heat output over time by maintaining heat output for a longer period and reducing peak temperatures.

It will of course be realized that while the foregoing has been given by way of illustrative example of this invention, all, such and other modifications and variations thereto as would be apparent to persons skilled in the art are deemed to fall within the scope and ambit of this invention as is herein described.

What is claimed is:

1. A firebox air control regulator for controlling combustion comprising:

a hollow body having an inlet and an outlet and forming an air passage for an airflow through said hollow body, said outlet being pneumatically connectable to an inlet to a firebox, a disc situated within said hollow body to provide resistance to said airflow and being movable along a support rod attached to said body, said hollow body comprising an upper portion and a lower portion, said air passage extending through said upper and lower portions and comprising an ovaloid opening that is larger than said disc, said air passage in said lower portion further comprising an inner surface further comprising a plurality of arc-shaped depressions and scalloped regions extending outwardly in three dimensions and being intermittently-spaced around said air passage to form a plurality of intermittently-spaced airflow channels between said inner surface and said disc at said intermittently-spaced arc-shaped depressions, said intermittently-spaced airflow channels continuously varying in size as said disc moves along said support rod within said lower portion, each said airflow channel being configured to direct a moving air column toward the perimeter of said disc to influence the movement of said disc and to support and stabilize said disc.

2. The air control regulator of claim 1 wherein the volume of air passing through each said airflow channel varies as said disc moves along said support rod.

3. The air control regulator of claim 1, further comprising upper and lower stop members to limit the maximum movement said disc.

4. The air control regulator of claim 1, said support rod being generally vertical such that said disc is held downward by gravity and is influenced upwardly by said plurality of intermittently-spaced moving air columns.

5. The air control regulator of claim 1, said ovaloid opening being configured to form a venturi chamber.

6. The air control regulator of claim 1 further comprising said disk being circular.

7. The air control regulator of claim 3, wherein said support rod further comprises said lower stop member.

8. The air control regulator of claim 1 wherein said support bar is rotationally and longitudinally adjustable by a first fixing member.

* * * * *